United States Patent [19]

Whiteley

[11] 4,170,102

[45] Oct. 9, 1979

[54] OPEN END SPINNING ROTOR WITH SPECIAL BOSS

[75] Inventor: John Whiteley, Clitheroe, England

[73] Assignee: Platt Saco Lowell Limited, Great Britain

[21] Appl. No.: 888,820

[22] Filed: Mar. 21, 1978

[30] Foreign Application Priority Data

Mar. 26, 1977 [GB] United Kingdom ..... 12844/77

[51] Int. Cl.[2] ..... D01H 1/12

[52] U.S. Cl. ..... 57/58.89

[58] Field of Search ..... 57/34 R, 58.89

[56] References Cited

U.S. PATENT DOCUMENTS

| | | | |
|---|---|---|---|
| 3,875,732 | 4/1975 | Ellingham | 57/58.89 |
| 3,884,100 | 10/1974 | Groasdale et al. | 57/58.89 |
| 3,986,332 | 10/1976 | Fukuda et al. | 57/58.89 |
| 4,008,561 | 2/1977 | Grau | 57/58.89 X |
| 4,070,814 | 1/1978 | Goldhammer | 57/58.89 X |

*Primary Examiner*—Donald Watkins

*Attorney, Agent, or Firm*—Donald H. Feldman

[57] ABSTRACT

A rotor for an open end yarn spinner is disclosed having a depending boss with a bore therethrough for interference fit with a supporting shaft, wherein the boss is formed with an annular concave recess proximal its juncture with the base of the cup portion of the rotor and its lower cup wall. Flexural distortion at high rotational speeds of from 45,000 to 60,000 or more r.p.m. occurs primarily at the area of the recess and is minimized at the region of interference fit such that the grip on the supporting shaft is not substantially loosened and the rotor mounted thereon is not shifted or dislodged.

10 Claims, 5 Drawing Figures

FIG.3.
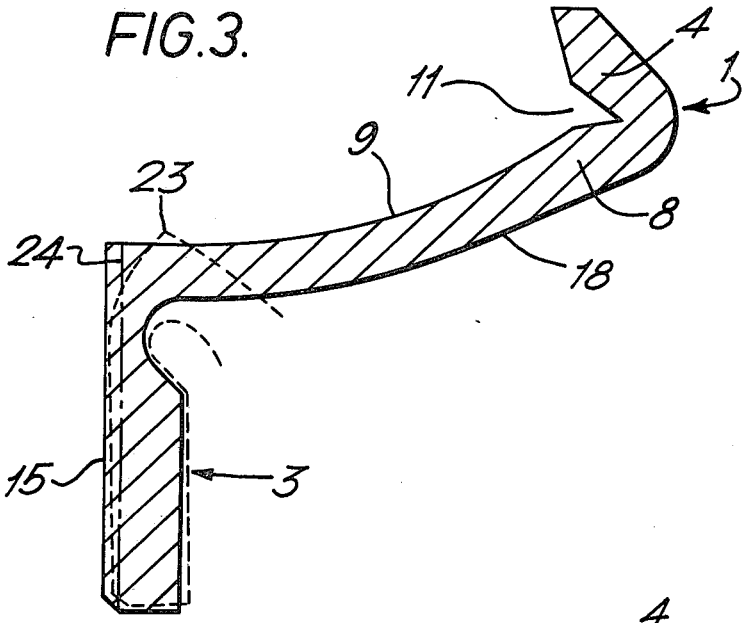
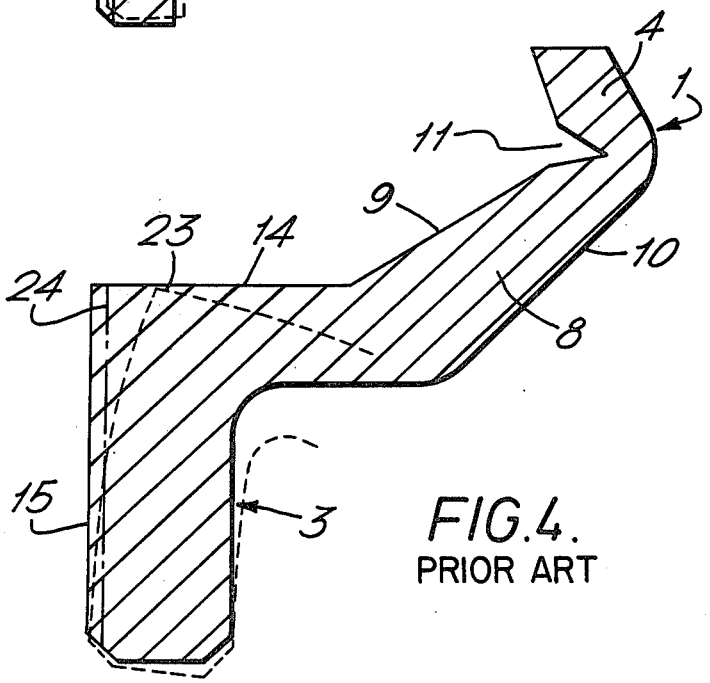
FIG.4.
PRIOR ART

OPEN END SPINNING ROTOR WITH SPECIAL BOSS

FIELD OF THE INVENTION

This invention relates to open end spinning rotors, and in particular rotors which may be employed at very high rotational speeds.

More particularly, the invention relates to a rotor of special construction which will remain securely fastened to its supporting shaft despite centrifugal distortions caused by very high spinning speeds.

BACKGROUND OF THE INVENTION

A particular advantage of the open end spinning of yarns over their production by "ring" spinning machines is speed, in which in identical time intervals open end machines can produce from three to ten times the amount of yarn as can ring spinners.

In efforts to increase this advantage, it has been proposed to increase the speeds of rotation of the yarn spinning rotor from a presently conventional 30,000 to 45,000 revolutions per minutes (r.p.m.) to speeds to excess of 55,000 r.p.m.

One problem encountered in such attempts has been that of retaining the rotor cup securely fastened to its supporting shaft or spindle, despite the extensive forces imposed at such very high rotational speeds. Among the these forces is the very great centrifugal force imposed upon the rotor cup and its interconnection with the shaft, which force increases with rotational speed and imparts bending and other distortional effects on these members.

Among methods conventionally employed to secure the rotor to its supporting shaft are fastenings through the use of detachable elements such as screws and the force fitting or "interference" fitting of the shaft into a bore of a terminal boss of the rotor.

While screw fastenings, such as are disclosed in German patent application (Offenlegungsschrift) No. 2441846 and British Pat. 1,410,972, as a concept are attractive in the promise of permitting the facile and rapid exchange of one rotor cup for another on the support shaft, such as may be required for example when one wishes to change the size of yarn to be produced or when a worn rotor cup is to replaced by an unworn cup, such fastenings give rise to the real problem of loosening in time during processing of fibers to yarn. In assembly of the rotor cup to the shaft, the connecting screw has to be tightened. The efficacy of this fastening resides not only in the amount of force used in the tightening and its consistent application from one rotor to shaft combination to another in the machine, but also in the strengths of the various joined components and their materials of construction, such as the screw itself, and its screw thread, and the female screw thread of the shaft as well as the resistance to distortion of the conjoined cup and shaft when tightening forces are applied. Further, the efficacy of fastening must be maintained throughout the yarn processing period when the shaft, cup, and conjoined screwthreads are subjected to the high forces previously mentioned. In all, screwthread fastenings raise severe doubts as to their efficacy, and especially so in efforts to raise the rotational speeds of rotors to higher and even higher levels.

In recognition of the foregoing, many commercial open end spinners employ the force or interference fit type of conjoining of rotor to supporting shaft. The prior art discloses many types of rotors so conjoined with their supporting shafts, such as in for example British No. 1,170,869; 1,200,355 and 1,228,358. More recent disclosures can be found in U.S. Pat. Nos. 4,068,456; 4,058,963; 4,022,011; 4,008,561; 3,981,132; 3,975,895; 3,973,382; and 3,972,171, for example.

Observation of force fit coupled rotor cups and shafts at high rotational speeds such as in excess of 55.000 r.p.m. discloses significant distortions at these speeds of the cup and its boss relative the supporting shaft, significant to the extent of reducing the grip of the boss on the shaft and permitting the cup and boss to be displaced on the shaft both axially and longitudinally. It has been found that at such high speeds there is a tendency for the bore through the boss to "expand" due to the effects of centrifugal forces acting upon the cup portion and the material of the boss, resulting in a loosening of the boss on the shaft. In such circumstances there is the danger that the rotor so loosened and displaced may contact adjacent elements such as, for example, the doffing tube which projects into the cup cavity, and the further danger that such displacement may be to the extent that the rotor may become completely detached from its shaft.

OBJECTS OF THE INVENTION

Thus, it is an object of this invention to provide a rotor construction for force fit coupling with a supporting shaft which at high rotational speeds in excess of 55,000 r.p.m. will not be dislodged from or dangerously displaced on its supporting shaft.

Another object of the invention is to provide such a rotor cup which at high speeds of rotation will flex in a manner such that the effect of centrifugal force is localized primarily in the region where the body of the cup and its appended boss meet and is minimized in the region of the boss beyond, so as to maintain secure coupling of rotor and shaft.

These and other desirable objects of the invention shall become apparent to one knowlegeable in the art through the explanations which follow.

SUMMARY OF THE INVENTION

It has now been discovered that the objects of this invention may be attained in a rotor construction wherein an annular, smoothly arcuate concavity is provided in the area where the outer walls of the rotor cup and its appended boss meet. This configuration provides for a diminuation of mass in that region which we have found permits maximum flexural movement to occur there and its concomitant displacement outwardly of the rotor cup and a minimization of outward flexural movement and displacement of those portions of the boss beyond, in all providing minimum "loosening" of the latter boss portions in interference fit with the supporting shaft.

DESCRIPTION OF THE DRAWINGS

A fuller understanding of the nature of the invention will be had through a reading of the following explanations of preferred embodiments of this invention as contrasted with prior art constructions, when taken in conjunction with the appended drawings in which:

FIG. 3, in similar elevation and section, shows one-half of the rotor of FIG. 2 somewhat enlarged, and in phantom dashed lines indicates flexural distortions which occur at high rotational speeds, these distortions being somewhat exaggerated in extent for purposes of illustration.

FIG. 4, otherwise similar to FIG. 3, shows one-half of a prior art rotor and its high rotational speed flexural distortions in phantom dashed lines.

PREFERRED EMBODIMENTS

Figure 1:
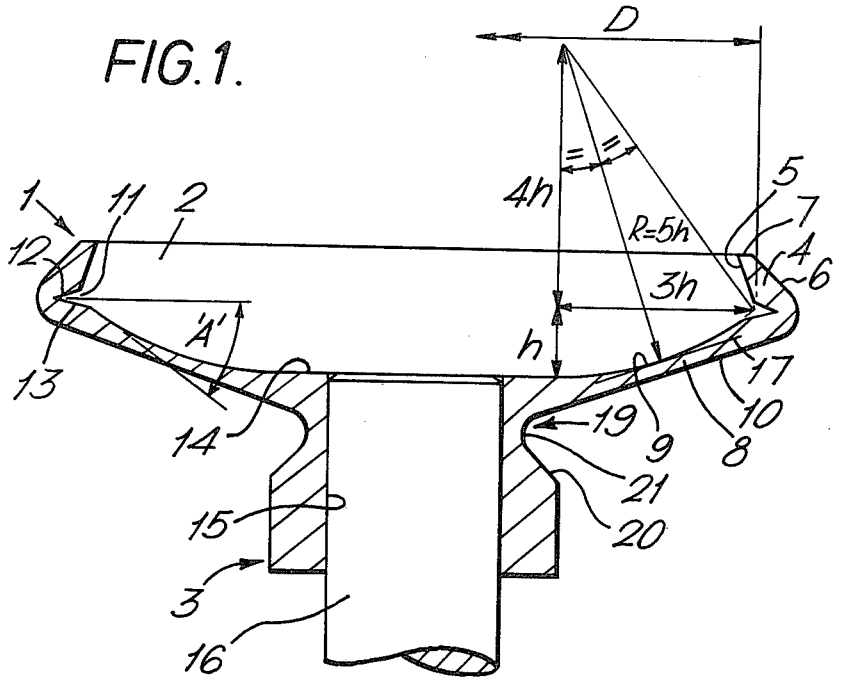
FIG. 1, in elevation and section, shows a first embodiment of the rotor construction of the invention.

With reference to FIG. 1, a rotor of the invention includes an open-topped cup portion 1 defining a cavity 2, and an annular boss portion 3 extending from the the inner base surface portion 14 of cup 1 outwardly.

Cup 1 includes upper and lower walls 4 and 8. Wall 4 has inner and outer frusto-conical surfaces 5 and 6 which extend outwardly from a rim 7 of cup 1. Wall 8 has an inner arcuate surface 9 and an outer frusto-conical surface 10 which surface 9 extends from cup base 14 outwardly to a region of maximum diameter D of cup 1. Inner surfaces 5 and 9 converge toward the region of maximum diameter D of cup 1 at which region the rates of convergence of surfaces 5 and 9 decreases to form within cup 1 a "V" shaped fiber collecting groove 11 having respective upper and lower surfaces 12 and 13 converging to an apex. Base inner surface 14 extends to a longitudinal bore or hole 15 formed through central boes 3 which bore 15 is coaxial with boss 3 and cup 1. The rotor is fixed on the end of a supporting shaft 16 by providing an interference fit between shaft 16 and boss 3 at bore 15, which fit is very close and strong. Preferably, boss 3 is a heavy force or press fit onto shaft 16 such that the end face of the portion of shaft 16 within bore 15 is coplanar with flat base 14, or substantially so.

In operation, the rotor is rotated at high speed such as, for example, in the range of 45,000 to 60,000 r.p.m. Fibers in discrete form are delivered into cavity 2 and under the aegis of centrifugal forces accumulate in an overlaying pattern within groove 11 where they are compacted by such forces between converging surfaces 12 and 13. The accumulated and compacted fibers are removed from groove 11 as they are twisted into the tail of a continuously formed yarn strand as the latter is withdrawn from cavity 2 through a doffing tube (not shown) which extends into cup 1 and its cavity 2 through the open top thereof.

To provide a rotor which can readily be inspected for dimensional accuracy, a preferred geometry is designated, wherein lower inner surface 9 of cup 1 is formed as a curved surface having a radius of curvature R which is five times the height h of groove 11 above base 14, and wherein the distance of the center of the radius of curvature R is three times height h from a point of intersection of imaginary extensions of surfaces 5 and 9. Base 14 is substantially tangential to the curvature of surface 9 at their point of meeting, shown at the point of the loer arrowhead for the dimension marked "h" in FIG. 1, and thus base 14, a substantially flat surface, and surface 9 conjoin to form a smooth continuous surface. At the point of intersection of lower inner surface 9 and groove surface 13 is defined an angle "A" between a tangent to surface 9 and a plane normal to the rotational axis of the rotor, wherein "A" is preferably 37°. Most preferably angle "A" does not exceed 45°. Such angles provide an inclination of surface 9 in the region of groove 11 which is consistent with satisfactory yarn removal therefrom during high speed rotation of cup 1. The angle of inclination of outer surface 10 of lower wall 8 in its frusto-conical form with respect to a plane normal to the rotational axis of the rotor is most desirably the same as and is shown to be that of a tangent line 17 passing through the midpoint of surface 9. Thus as shown, lower wall 8 has a minimum thickness between where its rate of convergence toward upper surface 5 changes, as previously mentioned in the formation of fiber collecting groove 11, and tangent line 17 extends substantially parallel to the line of inclination of frusto-conical surface 10.

Figure 2:
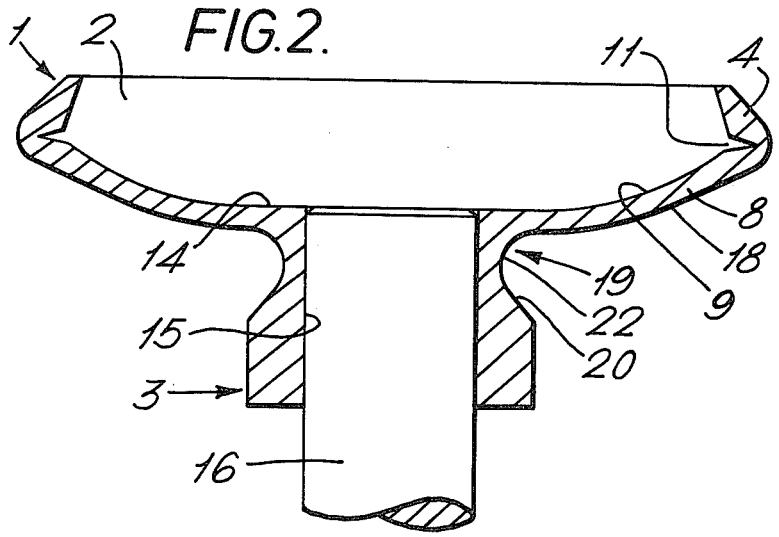
FIG. 2, in similar elevation and section, shows a second embodiment of the invention.

In a second embodiment of the invention, referring to FIG. 2, the geometries expressed for the preceding embodiment are the same regarding the internal surfaces of cup 1. However, the outer surface 18 of lower wall 8 of cup 1 is here curved so as to be concentric with its inner surface to provide a uniform wall thickness substantially throughout the extent thereof.

To practice the present invention, it is of importance to note that, as in FIGS. 1 and 2, the lower walls 8 of their respective rotors are bounded by inner and outer surfaces which contain no abrupt changes in direction. This has the felicitous effect of reducing or eliminating entirely points of high stress concentration during operation of the rotors. Further, the height h, previously defined, of the groove 11 is maintained as low as is possible consistent with accomodating cooperating spinning elements such as the separator/yarn doffing tube (not shown) within cavity 2. Yet further, the maximum diameter D, hitherto defined, is in the region of some tem times greater than the height h above base 14. Preferably diameter D is not less than some seven times the height h. These attributes provide a low elevation to the lower wall 8 with respect to base 14 and, it is believed, thus contribute to more favorable stress conditions in operation of the present rotor.

Figure 5:
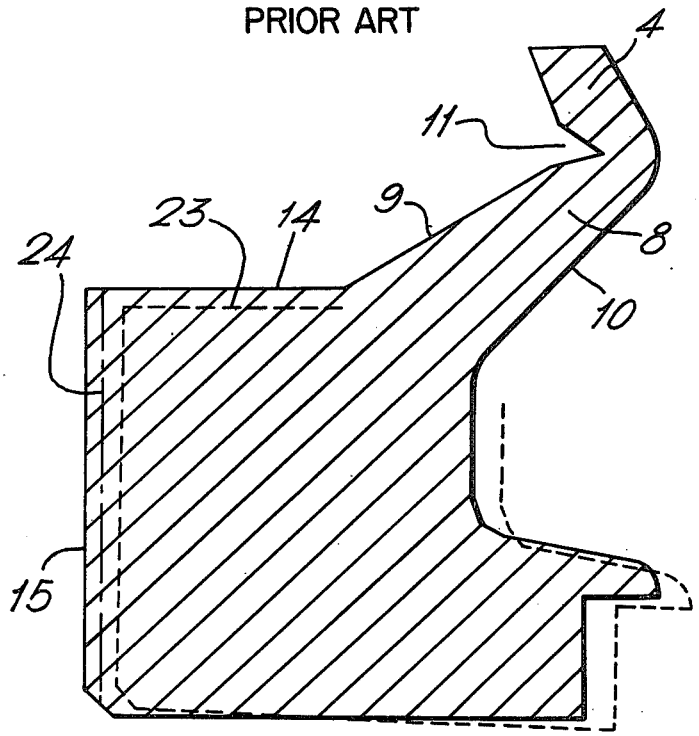
FIG.5. PRIOR ART
FIG. 5, also otherwise similar to FIG. 3, shows one-half of yet another prior art rotor and its high speed flexural distortions.

In contrast to the foregoing, known rotors such as those in FIGS. 4 and 5 often exhibit an abrupt change in direction at the junction of lower inner surface 9 of wall 8 and the flat base 14. In operation, this region has been found to be one of high stress concentration. At the higher and yet higher rotational speeds being demanded for increased yarn production, i.e, 60,000 r.p.m. and above, this region of high stress concentration represents a substantial problem which can result in bursting of the rotor having such an abrupt change.

Another region of high stress concentration at higher rotational stress resides where the outer wall surface of boss 3 meets outer lower wall surface 18. This invention is especially directed to such region.

With reference to FIG. 1, according to the invention there is provided an annular recess 19 in the wall of boss 3 immediately below the junction of lower wall 8 with boss 3. The generatrix of recess 19 is generally "v" shaped with an arcuate apex, the upper recess surface of which is formed by a smooth continuation of lower outer surface 10 of wall 8 and is joined to a lower recess surface 20 by a concave base surface 21. In the FIG. 2 embodiment, lower recess surface 20 joins surface 18 in a smooth manner by a continuous concave base surface 22.

The diameter of boss 3 at the base 21 or 22 of recess 19 is shown to be larger than the diameter of bore 15 by about 20 percent, to provide a thin-walled necked-portion in boss 3. Preferably the diameter of boss 3 at the apex or base 21 or 22 of annular recess 19 does not exceed the diameter of bore 15 by an amount greater than 30 percent thereof.

In operation of rotors of the present construction, under centrifugal forces, upper and lower walls 4 and 8 of cup 1 will flex outwardly and about the minimum diameter of boss 3, i.e. at the base 21 or 22 of annular recess 19. In FIG. 3 is seen the displacements occurring in such flexing of boss 3 and its bore 15 as indicated by the broken or phantom line 23. The displacement of the shaft 16 is indicated by the chain-dot line 24. It will be appreciated that in FIGS. 4 and 5 as well as in FIG. 3, the positional displacements of the walls of bore 15 and of the diameter or outer wall of shaft 16 as indicated respectively by the broken or phantom and the chain-dot lines 23 and 24 are determined before mounting the rotor onto shaft 16, for purposes of clear observation. These displacements occur at rotor speeds of 60,000 r.p.,. and are shown some 2,500 times actual size in the drawings.

From the drawings it is readily seen that minimum displacement of the boss occurs in the region corresponding to the thin-walled portion produced by annular recess 19. As the rotor is progressively rotated from rest to 60,000 r.p.m. it is observed that bore 15 tends to "open up" or expand with its walls being displaced outwardly toward the cup portion side of recess 19. At 60,000 r.p.m. the major portion of the axial length of the walls of bore 15 is still in contact with shaft 16.

In contrast to the foregoing, under the same conditions the prior art rotor of FIG. 4 shows its bore 15 to be progressively displaced with increase in rotational speed, but in a different manner. Displacement progressively increases from the end remote from cup portion 1. At high speed, only this end of the wall of bore 15 is still in contact with shaft 16. This results in an axial movement of the rotor on shaft 16 with an attendant danger that the spinning elements within cavity 2 such as the doffing tube may be contacted or that the rotor may fly off of shaft 16. In the prior art rotor of FIG. 5, displacement of the bore walls is substantially constant along their length and move the same wholely out of contact with shaft 15 at 60,000 r.p.m.

In yet alternate embodiments of the invention, in either of the rotors shown in FIGS. 1 and 2 an internal annular recess in the walls of boss 3 may be formed by increasing the bore diameter at a position intermediate the axial length of boss 3.

Having thus disclosed preferred embodiments of the invention, and having explained its operation and advantages in contrast with the prior art, one skilled in the art will readily be able to think of variations in contour and design, and materials of construction which may be employed to fabricate rotors of the invention which fall within the purview of its definitions as set forth by the claims which follow:

That which is claimed:

1. In a rotor for an open end spinning machine, including a cup portion having walls with a region of maximum diameter for the collection of fibers thereat and defining a cavity with an open top at one end for the removal of the collected fibers as yarn therefrom, a base portion at the other end of said cavity and a boss portion extending outwardly from said base portion, said boss being formed with a bore therethrough extending axially concentric with said boss, base and cup walls, wherein said bore is of such dimensions as to provide a strong intereference fit of said boss portion with a supporting shaft when the latter is fitted therein, the improvement comprising:

the portion of said cup walls, which extends between said region of maximum diameter of said cup and said respective base and boss portions thereof, being defined between inner and outer wall surfaces each surface of which is devoid of abrupt angular changes in direction;

said boss portion being formed with an annular concave recess having an outer wall surface which is smoothly conjoined to said outer wall surface of said portion of said cup walls and in a manner devoid of abrupt angular changes in direction; and said base portion being formed with a substantially planar surface which is smoothly conjoined to said inner wall surface of said portion of said cup walls and in a manner devoid of abrupt angular changes in direction.

2. The improvement as in claim 1, wherein said boss has a minimum diamete at said recess which is from 20 percent to 30 percent greater than the diameter of said bore.

3. The improvement as in claim 1, wherein said maximum diameter is at least seven times greater than the distance between the inner surface of the base and said diameter, and at most ten times said distance.

4. The improvement as in claim 3, wherein said maximum diameter is ten times the distance between said base surface and said diameter.

5. The improvement as in claim 1, wherein said boss is joined to a supporting shaft through a strong interference fit of an end of said shaft in said bore.

6. In an open end yarn spinning rotor, including a cup portion having walls with a region of maximum diameter for the collection of fibers thereat and defining a cavity with an open top at one end for the removal of the collected fibers as yarn therefrom, a base portion at the other end of said cavity, and a boss portion extending from said base portion, said boss portion being formed with a bore therethrough extending axially concentric with said boss, base and cup walls, wherein said bore is of such dimensions as to provide a strong interference fit of said boss portion with a supporting shaft when the latter is fitted therein, the improvement comprising:

said boss portion being formed with annular recess means for, under the aegis of rotational centrifugal forces exerted upon said rotor, permitting said cup portion to flex outwardly of its rotational axis and thereby displacing outwardly and opening up about said means for retention of said strong interference fit over a major portion of that portion of said shaft fitted within said bore, and wherein the portion of said cup walls, which extends between said region of maximum diameter of said cup and said respective base and boss portions thereof, being defined between inner and outer wall surfaces each surface of which is devoid of abrupt angular changes in direction, and being conjoined to the outer surface of said boss portion at its outer wall surface and to the inner surface of said base portion at its inner wall surface in a manner devoid of abrupt angular changes in direction.

7. The improvement as in claim 6, wherein said inner and outer wall surfaces are arcuate.

8. The improvement as in claim 6, wherein said outer wall surface is frusto-conical and said inner wall surface is arcuate.

9. The improvements as in claim 8, wherein said outer frusto-conical wall surface extends parallel to a tangent to a point on said inner wall surface.

10. The improvement as in claim 9, wherein said point is a midpoint of said inner arcuate wall surface between said region of maximum diameter and said base portion of said rotor.

* * * * *

UNITED STATES PATENT OFFICE

CERTIFICATE OF CORRECTION

PATENT NO. : 4,170,102

DATED : Oct. 9, 1979

INVENTOR(S) : John Whiteley

It is certified that error appears in the above-identified patent and that said Letters Patent are hereby corrected as shown below:

Col. 1, bridging lines 28 and 29, "Among the these forces" should read -- Among these forces --;

Col. 2, line 4, "British No." should read -- British specifications --;

Col. 2, line 9, the number "55.000" should read -- 55,000 --;

Col. 3, line 19, "extending from the the" should read -- extending from the --;

Col. 3, line 29, "decreases" should read -- decrease --;

Col. 3, line 34, "boes 3" should read -- boss 3 --;

Col. 3, line 63, "the loer arrowhead" should read -- the lower arrowhead --.

Col. 4, line 12, between "where its" and "rate of convergence" one should insert -- inner surface 9 joins the flat base surface 14 and where its --;

Col. 4, line 36, "some tem times" should read -- some ten times --;

Col. 5, line 21, "r.p.,." should read -- r.p.m. --; and

Col. 6, line 22, the second line of claim 2, "diamete" should read -- diameter --.

Signed and Sealed this

Nineteenth Day of August 1980

[SEAL]

Attest:

SIDNEY A. DIAMOND

Attesting Officer

Commissioner of Patents and Trademark